United States Patent [19]

Benedictus

[11] Patent Number: 5,034,721

[45] Date of Patent: Jul. 23, 1991

[54] HEATING ELEMENT CONVENIENTLY FORMED FROM FLAT BLANK

[75] Inventor: Jan H. Benedictus, Groningen, Netherlands

[73] Assignee: U.S. Philips Corp., New York, N.Y.

[21] Appl. No.: 398,125

[22] Filed: Aug. 24, 1989

[30] Foreign Application Priority Data

Aug. 26, 1988 [EP] European Pat. Off. ..... 88201825.2

[51] Int. Cl.[5] ..... H05B 3/10

[52] U.S. Cl. ..... 338/284; 338/283; 338/288; 338/293; 338/206; 338/58; 219/552; 392/360

[58] Field of Search ..... 338/51, 58, 206, 280, 338/283-284, 287-291, 293, 552; 219/375-376, 332, 381-382, 552; 392/360

[56] References Cited

U.S. PATENT DOCUMENTS

| | | | |
|---|---|---|---|
| 1,233,183 | 7/1917 | Carter et al. | 338/290 |
| 2,102,302 | 12/1937 | Arnold | 338/284 |
| 4,066,865 | 1/1978 | Godel et al. | 338/294 |
| 4,553,126 | 11/1985 | Brandstatter et al. | 338/287 |

FOREIGN PATENT DOCUMENTS

| | | | |
|---|---|---|---|
| 903775 | 11/1947 | France | 338/284 |
| 2608883 | 6/1988 | France . | |
| 178042 | 9/1935 | Switzerland | 338/287 |
| 361986 | 12/1931 | United Kingdom | 201/69 |

*Primary Examiner*—Bruce A. Reynolds
*Assistant Examiner*—John A. Jeffery
*Attorney, Agent, or Firm*—Ernestine C. Bartlett

[57] ABSTRACT

The invention relates to a method of manufacturing a heating element from a flat metal foil blank in which strips (1) are formed whose ends (2) are interconnected by connecting portions (3, 4) with alternate connecting portions disposed at opposite ends of the strips so as to form a meandering pattern and to a heating appliance incorporating such a heating element. In order to make such a foil heating element suitable for use in appliances in which an air stream to be heated passes over the foil heating element the connecting portions (3, 4) are bent in such a way that the strips (1) are tilted out of the plane of the foil blank. Preferably the strips are disposed an an angle α between 45° and 90° relative to the plane.

16 Claims, 2 Drawing Sheets

HEATING ELEMENT CONVENIENTLY FORMED FROM FLAT BLANK

BACKGROUND OF THE INVENTION

The invention relates to a method of manufacturing a heating element from a flat metal foil blank in which strips are formed, the ends of the strips being interconnected by connecting portions with alternate connecting portions disposed at opposite ends of the strips so as to form a meandering pattern and to a heating appliance incorporating such a heating element.

Such a method is generally known. The thin flat heating element thus obtained, also referred to as a foil heating element, is employed in, for example, cookers and electrical irons.

SUMMARY OF THE INVENTION

An object of the invention is to provide a foil heating element suitable for use in appliances in which an air stream to be heated passes over the foil heating element.

The method in accordance with the invention is characterized by bending the connecting portions in such a way that the strips are tilted out of the plane of the foil blank.

A heating appliance in accordance with the invention is characterized in that the connecting portions of the heating element are bent so that the strips project out of the plane of the blank Prior-art appliances producing a stream of hot air, such as fan heaters and hair driers generally employ thin helically wound resistance wires which are mounted to insulating, usually ceramic, supports. Since the circumferential surface area of such wires is small they have to be at a high temperature before they can heat air passing over the heating element. As a result of this the likelihood of corrosion increases, so that stringent requirements have to be imposed on the resistance to corrosion.

Also as it is difficult to control the spacing of the coils or turns of a helically wound resistance wire, bunching of the turns may occur resulting in hot spots in operation of the heating element. In addition, heat transfer to air passing over the heating element may be adversely affected because of the shielding of parts of the resistance wire by other parts of the helically wound resistance wire. Another disadvantage of the present helical wires is that the ceramic supports are susceptible to damage during transportation.

In comparison with these known filamentary heating elements, a foil heating element obtained by a method in accordance with the invention has the advantage that its cooling surface should be substantially larger because the resistance elements are constituted by strips. As a result of this the temperature of the strips remains much lower, so thai corrosion is substantially eliminated or at least reduced. In order to adapt the air circulation capacity and the thermal output to one another the strips are tilted relative to the foil blank, preferably through an angle between 45° and 90°.

Also using a method in accordance with the invention, the spacing and width of the strips can be relatively precisely controlled so that problems such as the formation of hot spots during operation of the heating element should be reduced.

An additional advantage is that, for example, fan heaters employing foil heating elements in accordance with the invention should produce less noise than fan heaters employing the known filamentary heating elements, in which the elements vibrate against the frame.

A preferred method is characterized in that the connecting portions are bent so that alternate strips are tilted in opposite directions out of the plane of the blank. Usually, viewed in the plane the strips are given identical arcuate or angular shapes which are oriented in the same direction and the connecting portions have a U-shape or V-shape with alternate connecting portions oriented in opposite directions. Thus, adjacent strips are spaced comparatively far apart, which minimizes or at least reduces the likelihood of the strips contacting one another and thereby producing a short-circuit.

Suitably, after the connecting portions are bent the foil blank is secured to a frame by fixing means. The fixing means are preferably formed from the foil blank and comprise fixing portions and narrow bridge portions, each bridge portion being situated between a connecting portion and a fixing portion. The narrow bridge portions function as a kind of thermal resistance, so that the bridge portions and fixing portions remain comparatively cool, which is an advantage for the connection to the frame and, in particular, the choice of the frame material. The bridge portions can also serve as a kind of tensioning means for the strips so that, when the strips are heated, instead of becoming slight)y warped or even sagging inside the frame, the strips remain constantly taut because of the pretensioning of the bridge portions.

BRIEF DESCRIPTION OF THE DRAWINGS

Embodiments of the invention will now be described in more detail, by way of example, with reference to the accompanying diagrammatic drawings. In the drawings

DETAILED DESCRIPTION OF THE PREFERRED EMBODIMENTS

Figure 1:
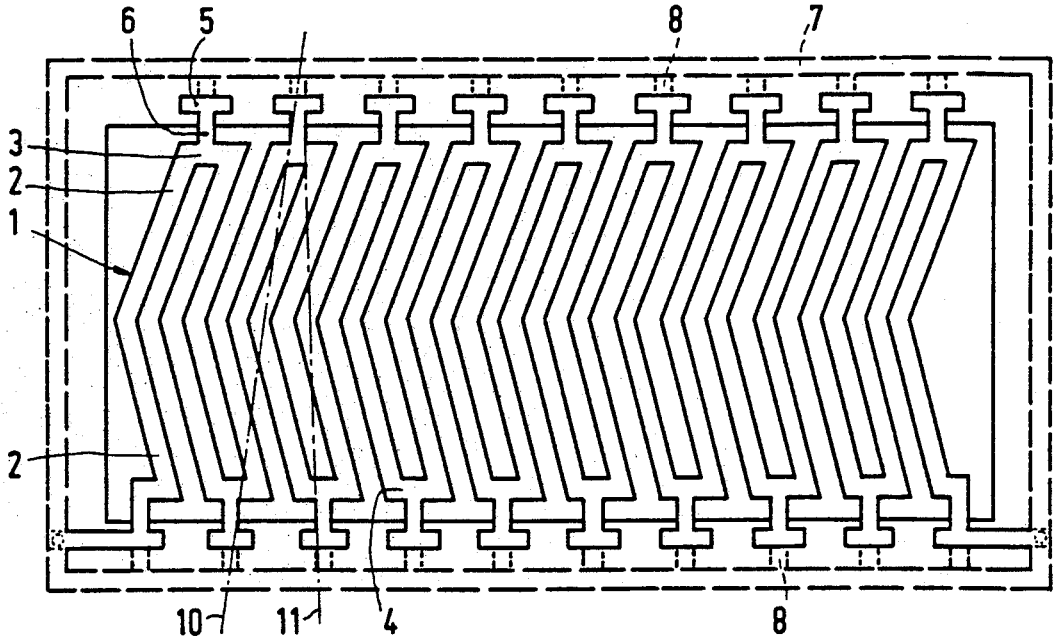
FIG. 1 shows a blank of a foil heating element prior to the bending process.
Figure 3:
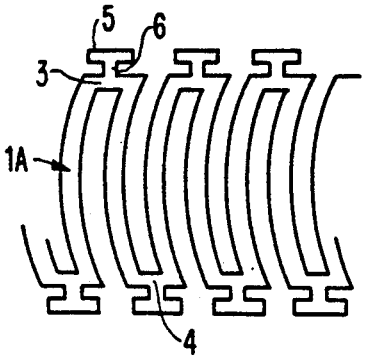
FIGS. 3 and 4 show different curvatures of the strips in the flat condition.
Figure 4:
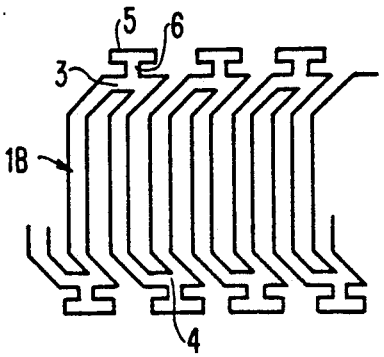

A foil blank as illustrated in FIG. 1 is cut or etched, from a flat thin (for example 100 micrometers thick) metal foil blank, suitably stainless steel. The element comprises strips 1 whose ends 2 are interconnected by connecting portions 3, 4 with alternate connecting portions disposed at opposite ends of the strips so as to form a meandering pattern. Viewed in the plane of the foil blank the strips are given identical arcuate or angular shapes which are oriented in the same direction. In FIG. 1 the strips consititute a herringbone type of pattern. However, other shapes are also possible such as an arcuate shape 1A (FIG. 3) or a bridge shape 1B (FIG. 4). The reason for this special shape will become apparent from the following paragraph. During the punching or etching operation, the foil blank is formed with fixing means each comprising a fixing portion 5 and a narrow bridge portion 6.

Figure 2:
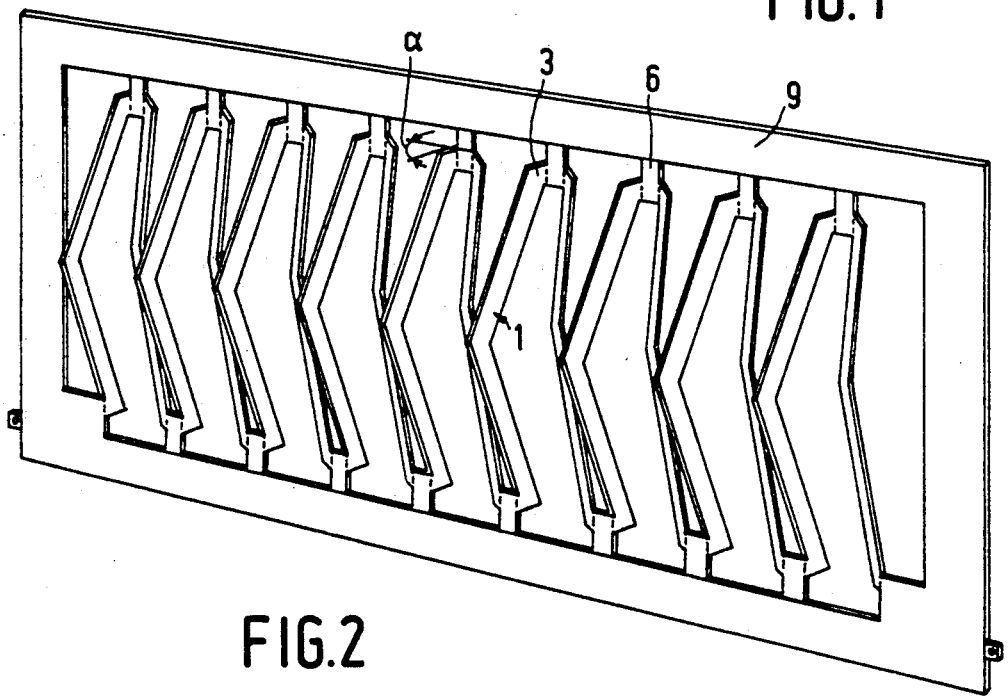
FIG. 2 is a perspective view of the foil heating element of FIG. 1 after the connecting portions have been bent.

To facilitate handling of the metal foil blank during further processing at this stage, as illustrated in dashed lines in FIG. 1, the strips 1 remain interconnected and supported by a surrounding border or frame portion 7 of the blank which is joined to each fixing portion 5 by a supporting portion 8. The connecting portions 3 at one end of the strips are bent into a U-shape or V-shape oriented in one direction and the connecting portions 4 at the other ends of the strips are bent into a U-shape or V-shape oriented in the opposite direction. As a result of this and as a result of the arcuate or angular shape the strips 1 are tilted alternately towards one side and towards the other side relative to the plane of the foil blank (see FIG. 2). Thus, the strips are in fact tilted about the lines 10 and 11 respectively. The principal advantage of this element is that two adjacent strips which project towards the same side are spaced far from one another because the interposed strip is oriented towards the other side. This minimizes the risk of short circuit. In practice, bending is effected about the lines 10 and 11 which are not situated in line with each other. Surprisingly, it has been found that the strips which project in one direction from the plane of the foil blank bend towards the same side when they are heated. This means that the likelihood of two adjacent strips being bent towards each other and contacting each other is smaller than if the strips would have no preferred bending direction.

The element thus obtained is now first secured to a frame 9, the fixing portions 5 being clamped between a double wall of the frame or being secured otherwise. During the securing of the element to the frame or in a subsequent operation, the supporting portions 8 are severed to free the element from the surrounding frame portion 7 and so separate the strips 1.

The connecting portions 3, 4 have a relatively large area and thus remain relatively cool during operation of the heating element. The bridge portions 6 are narrow and so function as thermal resistances. As a result of this the bridge portions 6 as well as the fixing portions 5 remain comparatively cool. This has the advantage that the frame 9 can be made of a plastic material.

Figure 5:
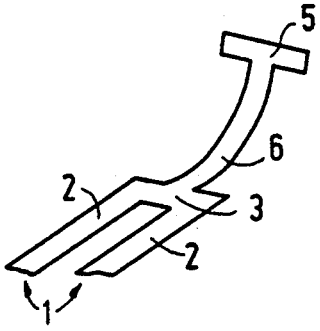
FIGS. 5 and 6 show different fixing means for connecting the strips to the frame.
Figure 6:
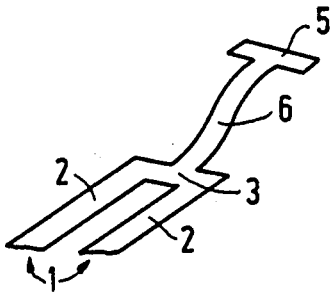

The bridge portions 6 may also assist in pretensioning for the strips. When the strips are heated they expand so that the strips are warped or may even sag, which increases the risk of a short circuit. By giving the bridge portions 6 an arcuate shape as shown in FIGS. 5 and 6, the strips always remain taut. Since the bridge portion does not assume a high temperature, its spring characteristics are preserved.

Figure 7:
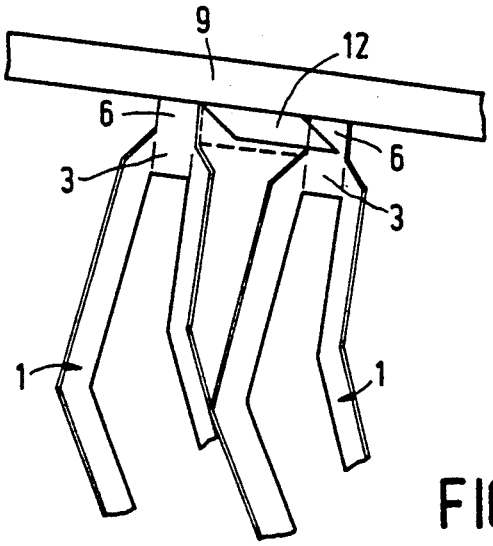
FIG. 7 is a partial perspective view on an enlarged scale of the heating element showing radiation shields.

Another feature is shown in FIG. 7. In this embodiment use is made of parts of the foil blank between the strips 1 as radiation shields. The parts are formed by square tabs 12 between connecting portions 3, 4 which may be bent through around 90 degrees to shield the frame 9 from radiated heat.

Figure 8:
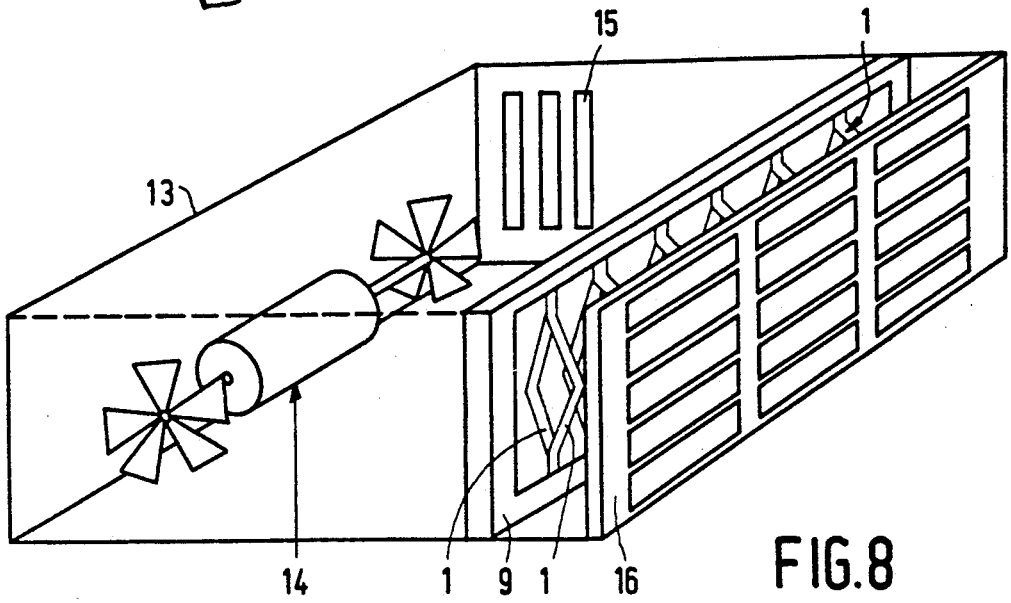
FIG. 8 is a schematic perspective view of a fan heater incorporating a heating element manufactured by a method embodying the invention.

The present foil heating element is very suitable for use in a fan heater. FIG. 8 is a schematic simplified perspective view of such a fan heater with part of the casing 13 cut away to show the heating element and fan and motor arrangement 14 mounted by conventional means (not shown) within the casing 13. In operation of the fan heater, the blades of the fan rotated by the motor arrangement 14 cause air to be drawn in through slots 15 in the casing and to pass transversely over the strips 1 where the air is heated by the heating element before passing out through the front gille 16 of the fan heater. Although only one heating element is shown in FIG. 8, several heating elements may be mounted in parallel to one another. In such a heater the air stream is oriented transversely of the foil blank. Depending on the desired air circulation capacity and thermal output the connecting portions are bent until the strips are disposed at an angle $\alpha$ between 45° and 90°.

Although it has been assumed in the arrangement described above that the strips 1 are of uniform width, the width of the strips may be varied, for example along their length, so as to control the heating of the strips. Thus, for example, a central portion of each strip may be designed to be thinner than the rest of the strip so that the central portions become hotter than the rest of the strip during operation thereby locating the maximum heating of air flowing over the strips 1 to a central portion of the heating element away from the frame 9.

The heating element has been described above as suitable for use in a forced air circulation heating appliance such as a fan heater. However the heating element may also be used in a natural convection heating appliance.

What is claimed is:

1. A method of manufacturing a heating element from a flat metal foil blank in which strips (1) are formed, the ends (2) of the strips being interconnected by connecting portions with alternate connection portions disposed at opposite ends of the strips as to form a meandering pattern, each connecting portion having a bridging portion disposed between strips that are adjacent, characterized by bending the connecting portions (3, 4) in such a way that the strips (1) are tilted out of the plane of the foil blank while the bridging portions of each connecting portion lies in the plane.

2. A method as claimed in claim 1, characterized by bending the connecting portions (3,4) so that the strips (1) are disposed at an angle ($\alpha$) between 45° and 90° relative to said plane.

3. A method as claimed in claim 1 or 2, characterized by bending the connecting portions (3,4) so that alternate strips (1) are tilted in opposite directions out of the plane of the blank.

4. A method as claimed in claim 3, characterized in that viewed in said plane the strips (1) have identical arcuate or angular shapes which are oriented in the same direction and in that the connecting portions (3,4) are bent into a U-shape or V-shape with alternate connecting portions oriented in opposite directions.

5. A method as claimed in claim 1, characterized in that, after the connecting portions (3,4) are bent, the foil blank is secured to a frame (9) by fixing means.

6. A method as claimed in claim 5, characterized in that the fixing means (5,6) are formed from the foil blank and comprise fixing portions (5,) and narrow bridge portions (6), each bridge portion being situated between a connecting portion, (3,4) and a fixing portion (5).

7. A method as claimed in claim 5, characterized in that between alternate connecting portions (3,4) tabs (12) are formed from the foil blank which tabs are bent up to shield the frame (9).

8. A heating appliance having a heating element formed from a flat metal foil and comprising strips (1) having ends (2) interconnected by connecting portions (3, 4) with alternate connecting portions disposed at opposite ends of the strips so as to form a meandering pattern, each connecting portion having a bridging portion disposed between strips that are adjacent, characterized in that the connecting portions of the heating element are bent in such a way that the strips (1) project out of the plane of the foil blank while the bridging portions of each connecting portion lies in the plane.

9. An appliance as claimed in claim 8, characterized in that the strips (1) are disposed at an angle between 45° and 90° relative to said plane.

10. An appliance as claimed in claim 8 or 9, characterized in that the connecting portions (3,4) are bent so that the strips (1) project in opposite directions out of the plane of the blank.

11. An appliance as claimed in claim 10, characterized in that viewed in said plane the strips (1) have identical arcuate or angular shapes which are oriented in the same direction and in that the connecting portions (3,4) are bent into a U-shape or V-shape with alternate connecting portions being oriented in opposite directions.

12. An appliance as claimed in claim 8, characterized in that the foil blank is secured to a frame (9) by fixing means.

13. An appliance as claimed in claim 12, characterized in that the fixing means (5,6) are formed from the foil blank and comprise fixing portions (5) and narrow bridge portions (6), each bridge portion being situated between a connecting portion (3,4) and a fixing portion (5).

14. An appliance as claimed in claim 12, characterized in that between alternate connecting portions (3,4) tabs (12) are formed from the foil blank which tabs are bent up to shield the frame (9).

15. A method of manufacturing a heating element from a flat metal foil blank wherein strips are formed, the strips having ends interconnected by connecting portions and alternate connecting portions disposed at opposite ends of the strips to form a meandering pattern, characterized by bending the connecting portions so that the strips are tilted out of the plane of the foil while the connecting portions retain a U-shape or a V-shape and alternate connecting portions have the U-shape or the V-shape oriented in opposite directions.

16. A heater having a heating element formed from a flat metal foil blank occupying a plane comprising strips having ends interconnected by connecting portions with alternating connecting portions disposed at opposite ends of the strips to form a meandering pattern, wherein the connecting portions of the heating element are bent so that the strips project out of the plane of the foil while the connecting portions retain a U-shape or a V-shape and alternating connecting portions extend in opposite directions from the plane.

* * * * *